United States Patent [19]

Mercer et al.

[11] Patent Number: 4,745,962

[45] Date of Patent: May 24, 1988

[54] COUNTERGRAVITY CASTING APPARATUS

[75] Inventors: James B. Mercer, Saginaw; Karl D. Voss, Standish, both of Mich.

[73] Assignee: General Motors Corporation, Detroit, Mich.

[21] Appl. No.: 77,891

[22] Filed: Jul. 27, 1987

[51] Int. Cl.[4] ..... B22D 18/06

[52] U.S. Cl. ..... 164/255; 164/63; 164/256; 164/361; 164/363

[58] Field of Search ..... 164/255, 254, 256, 63, 164/65, 350, 361, 363

[56] References Cited

U.S. PATENT DOCUMENTS 4,340,108 7/1982 Chandley et al. ..... 164/63
4,508,157 4/1985 Belliveau et al. ..... 164/63
4,616,691 10/1986 Voss ..... 164/255
4,632,171 12/1986 Almond ..... 164/255
4,641,703 2/1987 Voss et al. ..... 164/255

*Primary Examiner*—Nicholas P. Godici
*Assistant Examiner*—J. Reed Batten, Jr.
*Attorney, Agent, or Firm*—Lawrence B. Plant

[57] ABSTRACT

Apparatus for the shaping of metal in a bottom-gated mold by the vacuum-induced countergravity casting method including an upstanding levee on the periphery of the drag and circumscribing the chamber-to-mold joint and/or the cope-to-drag joint for isolating such joint(s) when the mold is immersed in an underlying melt.

3 Claims, 1 Drawing Sheet

COUNTERGRAVITY CASTING APPARATUS

This invention relates to apparatus for the vacuum-induced, countergravity casting of metal in gas-permeable molds and, more particularly, to means for isolating the cope-to-drag and vacuum chamber-to-mold seals from the underlying melt.

BACKGROUND OF THE INVENTION

The vacuum-induced, countergravity, casting process is useful in the making of thin-walled near-net-shape castings and involves: sealing a bottom-gated mold, having a gas-permeable upper portion, to the mouth of a vacuum chamber such that the chamber confronts the upper portion; immersing the underside of the mold in an underlying melt; and evacuating the chamber to draw melt up into the mold through one or more of the gates in the underside thereof. Such a process is shown in Chandley et al. U.S. Pat. No. 4,340,108 wherein the mold comprises a resin-bonded-sand shell having an upper cope portion sealingly bonded (e.g., glued) to a lower drag portion and the vacuum chamber sealed atop the cope such that the parting line between the cope and drag lies outside the vacuum chamber. Almond U.S. Pat. No. 4,632,171, assigned to the assignee of the present invention, is an improvement on Chandley et al. U.S. Pat. No. 4,340,108 and seals the mold to the vacuum chamber atop the drag such that the parting line between the cope and drag falls within the vacuum chamber. In such processes, it is desirable to immerse the drag as far as possible into the melt to prevent invasion of the mold cavity by air being sucked through any portions of the porous drag which might be above the melt surface. Hence, in both the Chandley et al and Almond cases, the parting line between the cope and the drag is brought into close proximity to the surface of the underlying melt during casting. Moreover, in Almond's case, the seal between the vacuum chamber and the mold is also brought into close proximity to the surface of the underlying melt during immersion.

It is undesirable to have melt contact either the parting line between the cope and the drag or the joint between the vacuum chamber and the mold. In this regard, melt at the parting line: (1) can cause gasification of any glue therein which gases are drawn into the mold cavity and can be trapped in the casting; and (2) can be sucked into the mold cavity at the parting line thereby ruining the casting. Moreover, hot melt at the chamber-mold joint can be sucked directly into the vacuum chamber causing ignition of the gases therein and result in destruction of the mold, casting and possibly the chamber itself.

It is not always possible to control precisely the depth that the mold is immersed into the underlying melt. Hence there is a risk that the cope-to-drag parting line and/or the chamber-to-mold joint may accidentally be contacted by the hot melt unless some technique can be devised for isolating them from the melt under all circumstances.

It is an object of the present invention to provide improved apparatus for the vacuum-induced, countergravity casting of metal into porous, bottom-gated molds wherein the cope-to-drag parting line and/or the chamber-to-mold joint is isolated from the melt over a wide range of immersion depths. This and other objects and advantages of the present invention will become more readily apparent from the description thereof which follows.

BRIEF DESCRIPTION OF THE INVENTION

Essentially the invention comprehends countergravity casting apparatus of the aforesaid type wherein the drag includes a peripheral levee circumscribing the chamber-to-mold joint and/or the cope-to-drag parting line to prevent melt from the underlying melt from contacting the joint or parting line over a wide range of mold immersion depths including depths where the chamber-to-mold joint and/or the cope-to-drag parting line are beneath the surface of the melt during casting. The levee formed on the drag permits melt to rise high up along the sides of the mold without invading the parting line or joint and making deletorious incursions into either the mold cavity or vacuum chamber. In the case of resin-bonded-sand molds, the levee will preferably be formed on the drag by molding against a drag-shaping pattern ala the drag-forming method of Almond U.S. Pat. No. 4,632,171 which is intended to be incorporated herein by reference as it relates to such method.

BRIEF DESCRIPTION OF THE DRAWINGS

The invention will better be understood when considered in the light of the following detailed description of certain embodiments of the invention which are described hereafter in conjunction with the several Figures in which.

DESCRIPTION OF SPECIFIC EMBODIMENTS

Figure 1:
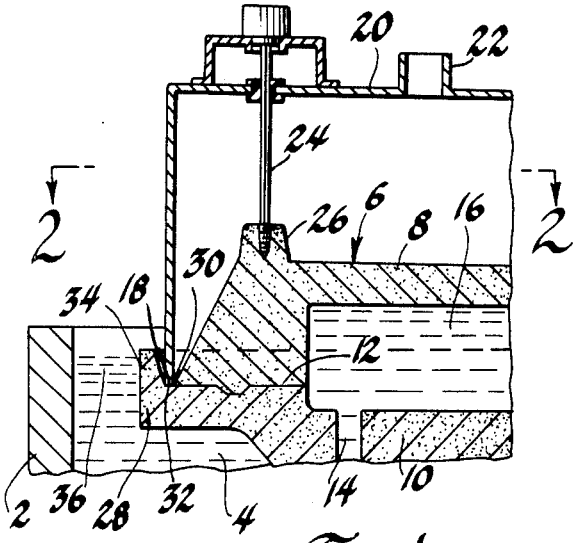
FIG. 1 is a partial side sectional view (i.e., in the direction 1—1 of FIG. 2) through a vacuum-induced, countergravity metal casting apparatus in accordance with the present invention.
Figure 2:
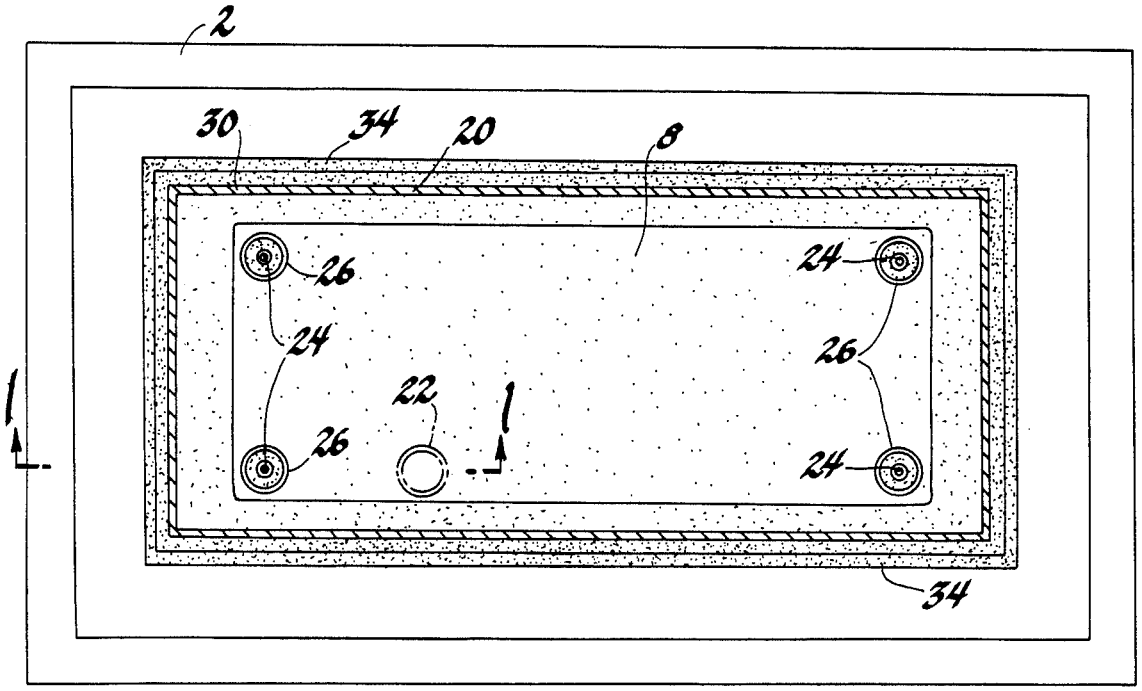
FIG. 2 is a plan view of the apparatus of FIG. 1. (i.e., in the direction 2—2 of FIG. 1)

FIGS. 1 and 2 show a vessel 2 of metal melt 4 which is to be drawn up into the mold 6. The mold 6 include a gas-permeable, upper (i.e., cope) portion 8 joined (e.g., glued) to a lower (i.e., drag) portion 10 along parting line 12 which defines therebetween a mold cavity 16. The lower drag portion 10 includes a plurality of ingates 14 on the underside thereof for supplying melt to the mold cavity 16 when the cavity is evacuated. The drag portion 10 of the mold 6 is sealed to the lip 18 at the mouth of a vacuum chamber 20 such that the gas-permeable upper portion 8 is encompassed by the chamber 20. The vacuum chamber 20 is communicated to a vacuum source (not shown) via conduit 22. The upper portion 8 of the mold 6 comprises a gas-permeable material (e.g., resin-bonded-sand) which permits gases to be withdrawn from the mold cavity 16 when a vacuum is drawn in the chamber 20. The lower portion 10 of the mold 6 may conveniently comprise the same material as the upper portion 8, or other materials, permeable or impermeable, which are compatible with the upper portion material. The mold 6 may be secured to the chamber 20 by means of inverted threaded shafts 24 which are screwed onto upstanding mounting lugs 26 in the manner described in U.S. Pat. No. 4,658,880 in the name of Karl Voss and assigned to the assignee of the present invention. Other methods of securing the mold to the chamber are acceptable as well.

The drag portion 10 of the mold 6 includes a peripheral flange 28 which extends outboard the peripheral edge 30 of the cope 8. The flange 28 includes: (1) a flat upper surface 32 for sealingly engaging the lip 18 of the chamber 20 (e.g., via a Fiberfax [not shown] insulating material; and (2) an upstanding levee 34 circumscribing the upper surface portion 32 (and hence the joint between the lip 18 and the surface 32). As shown in FIG. 1, the levee 34 permits immersion of the mold so deep in the melt 4 that the joint between the chamber 20 and the surface 32 lies beneath the surface 36 of the melt yet is isolated from the melt by the levee 34.

Figure 3:
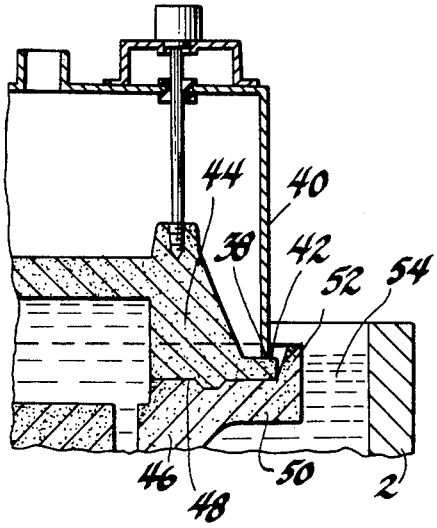
FIG. 3 is a partial side sectional view, like that of FIG. 1, but of another embodiment of the present invention.

FIG. 3 depicts another embodiment of the present invention wherein the lip 38 on the mouth of the chamber 40 sealingly engages a flat surface 42 atop the cope 44. The cope 44 engages the drag 46 along the parting line 48. The drag 46 has a flange 50 extending outboard the cope 44 which flange includes an upstanding levee 52 circumscribing the parting line 48 and isolating it from contact with the melt 54 as described above.

While the invention has been disclosed in terms of specific embodiments thereof it is not intended to be limited thereto but rather only to the extent set forth hereafter in the claims which follow.

The embodiments of the invention in which an exclusive property or privilege is claimed are defined as follows:

1. Apparatus for shaping a metal article in a bottom-gated mold by the vacuum-induced, countergravity casting method wherein the mold is immersed in an underlying melt of said metal and evacuated to draw said melt up into said mold, said apparatus comprising:

a gas-permeable cope portion of said mold defining a mold cavity for shaping said article, said cope portion having a peripheral edge defining a first sealing face on its underside between said edge and said cavity;

a drag portion of said mold further defining said cavity and having a second sealing face on its topside surrounding said cavity;

means for sealingly engaging said first and second sealing faces one to the other at a parting line therebetween;

a flange on said drag portion extending outboard said second sealing face beyond said peripheral edge, said flange having a substantially flat upper surface portion and an upstanding levee portion circumscribing said upper surface portion to substantially isolate said upper surface portion from said melt when said mold is immersed in said melt;

a vacuum chamber atop said drag portion and enclosing said cope portion, said chamber having a lip on its underside sealingly engaged with said upper surface portion; and means for evacuating said chamber sufficiently to draw said melt up into said mold when it is immersed in said melt.

2. Apparatus for shaping a metal article in a bottom-gated, expendable shell mold by the vacuum-induced, countergravity casting method wherein the mold is immersed in an underlying melt of said metal and evacuated to draw said melt up into said mold, said apparatus comprising:

a cope portion of said mold comprising a gas-permeable, resin-bonded-sand shell formed by molding against a cope-shaping pattern, said cope portion defining a mold cavity for shaping said article and having a peripheral edge defining a first sealing face on the underside of said cope portion between said edge and said cavity;

a drag portion of said mold comprising a resin-bonded-sand shell formed by molding against a drag-shaping pattern, said drag portion further defining said cavity and having a second sealing face on its topside surrounding said cavity;

means for sealingly engaging said first and second sealing faces one to the other at a parting line therebetween;

a flange on said drag portion extending outboard said second sealing face beyond said peripheral edge, said flange having a substantially flat upper surface portion and an upstanding levee portion circumscribing said upper surface portion to substantially isolate said upper surface portion from said melt when said mold is immersed in said melt, said upper surface and said levee portions being formed against said drag-shaping pattern at the time said drag portion was molded;

a vacuum chamber atop said drag portion and enclosing said cope portion, said chamber having a lip on its underside sealingly engaged with said upper surface portion of said flange; and means for evacuating said chamber sufficiently to draw said melt up into said mold when it is immersed in said melt.

3. Apparatus for shaping a metal article in a bottom-gated mold by the vacuum-induced, countergravity casting method wherein the mold is immersed in an underlying melt of said metal and evacuated to draw said melt up into said mold, said apparatus comprising:

a gas-permeable cope portion of said mold defining a mold cavity for shaping said article, said cope portion having a peripheral edge defining a first sealing face on its underside between said edge and said cavity;

a drag portion of said mold further defining said cavity and having a second sealing face on its topside surrounding said cavity;

means for sealingly engaging said first and second sealing faces one to the other at a parting line therebetween;

a flange on said drag portion extending outboard said second sealing face beyond said peripheral edge, said flange having an upstanding levee portion thereon circumscribing said second sealing face to substantially isolate said parting line from said melt when said mold is immersed in said melt;

a vacuum chamber atop said mold confronting a substantial portion of said cope portion, said chamber having a lip on its underside sealingly engaged with said mold; and means for evacuating said chamber sufficiently to draw said melt up into said mold when it is immersed in said melt.

* * * * *